US006807882B2

(12) United States Patent
Hu

(10) Patent No.: US 6,807,882 B2
(45) Date of Patent: Oct. 26, 2004

(54) WRENCH WITH A SIMPLIFIED STRUCTURE

(76) Inventor: Bobby Hu, 8F, 536-1, Ta Chin Street, Taichung (TW)

( * ) Notice: Subject to any disclaimer, the term of this patent is extended or adjusted under 35 U.S.C. 154(b) by 41 days.

(21) Appl. No.: 10/142,001

(22) Filed: May 8, 2002

(65) Prior Publication Data

US 2002/0162424 A1 Nov. 7, 2002

Related U.S. Application Data

(63) Continuation-in-part of application No. 09/850,285, filed on May 7, 2001, now abandoned.

(51) Int. Cl.[7] ..... B25B 13/46
(52) U.S. Cl. ..... 81/60; 81/58
(58) Field of Search ..... 81/58, 60

(56) References Cited

U.S. PATENT DOCUMENTS

| | | | |
|---|---|---|---|
| 15,482 | A | 8/1856 | Gilman |
| 810,599 | A | 1/1906 | Ansorge |
| 841,686 | A | 1/1907 | Hatfield |
| 893,097 | A | 7/1908 | Reams |
| 915,446 | A | 3/1909 | Kearnes |
| RE13,205 | E | 2/1911 | Lane |
| 1,033,358 | A | 7/1912 | Turner |
| 1,078,059 | A | 11/1913 | Mossberg |
| 1,194,471 | A | 8/1916 | Boosinger |
| 1,261,092 | A | 4/1918 | Allen |
| 1,382,492 | A | 6/1921 | Evans |
| 1,426,127 | A | 8/1922 | Tuttle |
| 1,614,039 | A | 1/1927 | Mandl |
| 1,957,462 | A | 5/1934 | Kress |
| 2,193,984 | A | 3/1940 | Rhinevault |
| 2,201,705 | A | 5/1940 | Stone |
| 2,201,827 | A | 5/1940 | Froeschl et al. |
| 2,317,461 | A | 4/1943 | Jackson |
| 2,542,241 | A | 2/1951 | Fors |
| 2,657,604 | A | 11/1953 | Rueb |
| 2,701,977 | A | 2/1955 | Stone |
| 2,764,048 | A | 9/1956 | Thompson |
| 2,769,360 | A | 11/1956 | Cottrell et al. |
| 2,800,821 | A | 7/1957 | Fruscella |
| 2,891,434 | A | 6/1959 | Lozensky |
| 2,957,377 | A | 10/1960 | Hare |
| 2,978,081 | A | 4/1961 | Lundin |
| 3,019,682 | A | 2/1962 | Hare |
| 3,250,157 | A | 5/1966 | Badger |
| 3,265,171 | A | 8/1966 | Kilness |
| 3,337,014 | A | 8/1967 | Sandrick |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

OTHER PUBLICATIONS

Tool and Manufacturing Engineers Handbook, 1976, 3rd Edition, pp. 6–48.

*Primary Examiner*—James G. Smith
(74) *Attorney, Agent, or Firm*—Alan D. Kamrath; Nikolai & Mersereau, P.A.

(57) ABSTRACT

A wrench includes a handle, a head extended from the handle, and a drive member rotatably mounted in a compartment of the head. A cavity is defined in a web between the handle and the head and communicated with the compartment. A transverse hole is defined in the web and includes an inner end communicated with the cavity and an outer end communicated with outside. A pawl is slidably mounted in the cavity and includes a toothed side, an attachment side, and a pressing side. An elastic element includes a first end attached to the attachment side of the pawl and a second end attached to an anchor securely mounted in the transverse hole. The toothed side of the pawl is biased to engage with the drive member and the pressing side of the pawl is biased to press against a wall defining the cavity.

19 Claims, 12 Drawing Sheets

U.S. PATENT DOCUMENTS 3,393,587 A 7/1968 Jolliff et al.
3,393,780 A 7/1968 Kilness
3,436,992 A 4/1969 Over et al.
3,577,816 A 5/1971 Alexander et al.
3,713,356 A 1/1973 Knudsen
3,742,788 A 7/1973 Priest
3,838,614 A 10/1974 O'Donnell
3,908,487 A 9/1975 Plaw
4,070,932 A 1/1978 Jeannotte
4,111,077 A 9/1978 Cummings et al.
4,128,025 A 12/1978 Main et al.
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Deibert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,807,500 A 2/1989 Main
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,495,783 A 3/1996 Slusar et al.
5,499,560 A 3/1996 Aeschliman
5,501,124 A 3/1996 Ashby
5,509,333 A 4/1996 Rion
5,533,427 A 7/1996 Chow
5,557,994 A 9/1996 Nakayama
5,582,081 A 12/1996 Lin
5,584,220 A 12/1996 Darrah et al.
5,595,095 A 1/1997 Hillinger
5,626,061 A 5/1997 Whitley
5,626,062 A 5/1997 Colvin
5,636,557 A 6/1997 Ma
5,669,875 A 9/1997 van Eerdenburg
5,709,137 A 1/1998 Blacklock
5,782,147 A 7/1998 Chaconas et al.
5,794,496 A 8/1998 Arnold
5,829,326 A 11/1998 Richner
5,842,391 A 12/1998 Chaconas
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen
6,205,889 B1 3/2001 Hsieh
6,209,423 B1 4/2001 Shiao
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,257,097 B1 7/2001 I-He
6,260,448 B1 7/2001 Chaconas
6,260,449 B1 7/2001 I-He
6,263,767 B1 7/2001 Hu
6,282,991 B1 9/2001 Hu
6,282,992 B1 9/2001 Hu
6,282,993 B1 9/2001 Forman et al.
6,301,998 B1 10/2001 Hu
6,431,031 B1 8/2002 Hu
6,435,062 B1 8/2002 McCann
6,435,063 B1 8/2002 Chen
6,446,530 B1 * 9/2002 Chang ..... 81/60
6,450,066 B1 9/2002 Hu
6,450,068 B1 9/2002 Hu
6,453,779 B2 9/2002 Hu
6,457,387 B1 10/2002 Hu
6,457,389 B1 10/2002 Hu
6,488,136 B2 12/2002 Chang
6,520,051 B1 2/2003 Hu
2001/0035074 A1 11/2001 Hu
2002/0017169 A1 2/2002 Hu
2002/0023519 A1 2/2002 Hu
2002/0023520 A1 2/2002 Hu
2002/0026858 A1 3/2002 Hu
2002/0062718 A1 5/2002 Wang
2002/0088312 A1 7/2002 Ling et al.
2002/0112573 A1 8/2002 Hu
2002/0166416 A1 11/2002 Hu
2002/0166417 A1 11/2002 Hu
2002/0194950 A1 12/2002 Hu
2003/0010159 A1 1/2003 Hu
2003/0010163 A1 1/2003 Hu
2003/0012614 A1 1/2003 Hu
2003/0019335 A1 1/2003 Hu

* cited by examiner

WRENCH WITH A SIMPLIFIED STRUCTURE

CROSS REFERENCE TO RELATED APPLICATION

This is a continuation-in-part application of U.S. patent application Ser. No. 09/850,285 filed on May 7, 2001, which is now abandoned.

BACKGROUND OF THE INVENTION

1. Field of the Invention

The present invention relates to a wrench with a simplified structure.

2. Description of the Related Art

U.S. Pat. No. 5,636,557 to Ma issued on Jun. 10, 1997 discloses a ratchet type ring spanner comprising a handle and a head portion extended from the handle. The head portion includes a circular peripheral wall defining a receiving compartment therein and a web area connected with the handle. A ratchet wheel is received in the compartment. An arcuate toothed member is mounted in a cavity defined in the web area and includes teeth on a side thereof for engaging with the teeth in an outer periphery of the ratchet wheel. A stop member is mounted in the cavity and includes an end bearing against the wall defining the cavity. A spring is mounted between the stop member and the toothed member to bias the toothed member away from the stop member. However, the wall defining the cavity must be processed to provide a depression for securely receiving a U-shape anchor of the stop member. The stop member and two wings on the stop member must be configured to correspond with the depression. These increase difficulty in manufacture, and there is a risk of disengagement of the anchor from the depression. The overall structure is complicated and the manufacture cost is relatively high. In operation, the wings of the stop member slide for a distance when the arcuate toothed member is driven by the ratchet wheel. It was, however, found that the wings tend to break, as the area of the wings subject to force is relatively small. In addition, the anchor tends to be carried away by the wings and is thus disengaged from the depression, which results in malfunction of the spanner.

SUMMARY OF THE INVENTION

It is the primary object of the present invention to provide an improved wrench with a simplified structure to thereby save the cost and time for assembly.

It is another object of the present invention to provide an improved wrench with a simplified structure, wherein malfunction resulting from sticking of the pawl to the drive member of the wrench is prevented.

A wrench in accordance with the present invention comprises:

a handle;

a head extended from the handle and including a compartment, a web being defined between the handle and the head, a cavity being defined in the web and communicated with the compartment, a transverse hole being defined in the web and including an inner end communicated with the cavity and an outer end communicated with outside;

a drive member rotatably mounted in the compartment and including a plurality of teeth on an outer periphery thereof;

a pawl slidably mounted in the cavity and including a toothed side, an attachment side, and a pressing side;

an anchor securely mounted in the transverse hole; and an elastic element including a first end attached to the attachment side of the pawl and a second end attached to the anchor, the pawl being biased by the elastic element such that the toothed side of the pawl is biased to engage with the teeth of the drive member and that the pressing side of the pawl is biased to press against a wall defining the cavity.

The anchor includes an embossed end for frictional engagement with an inner periphery defining the transverse hole. The attachment side of the pawl includes a peg to which the first end of the elastic element is attached. In a case that the pawl is stuck to the drive member, the peg is impinged by another end of the anchor when the handle is turned in a free rotating direction and thus causes disengagement of the pawl from the drive member.

In an embodiment of the invention, the drive member includes a protruded portion on a top thereof. A ring cap is mounted around the protruded portion and includes an annular groove in an outer periphery thereof. An inner periphery defining the compartment of the head includes an upper portion with an annular groove. A C-clip is engaged in the annular groove of the protruded portion of the drive member and the annular groove of the head, thereby rotatably mounting the drive member in the compartment of the head. The inner periphery defining the compartment of the head includes an annular ledge projecting inward from a lower portion thereof. The drive member includes an inner periphery for engaging with a fastener. The inner periphery of the drive member includes a plurality of faces, each two adjacent faces having a concave portion therebetween.

In another embodiment of the invention, the anchor includes a flange on an outer periphery thereof and located in the cavity, and the second end of the elastic element is attached to the flange of the anchor.

In a further embodiment of the invention, the anchor includes a protrusion on an outer periphery thereof and located in the cavity, and the second end of the elastic element is attached to the protrusion of the anchor.

In still another embodiment. of the invention, the transverse hole is a screw hole, and the anchor includes a threaded section that is threadedly engaged in the screw hole.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
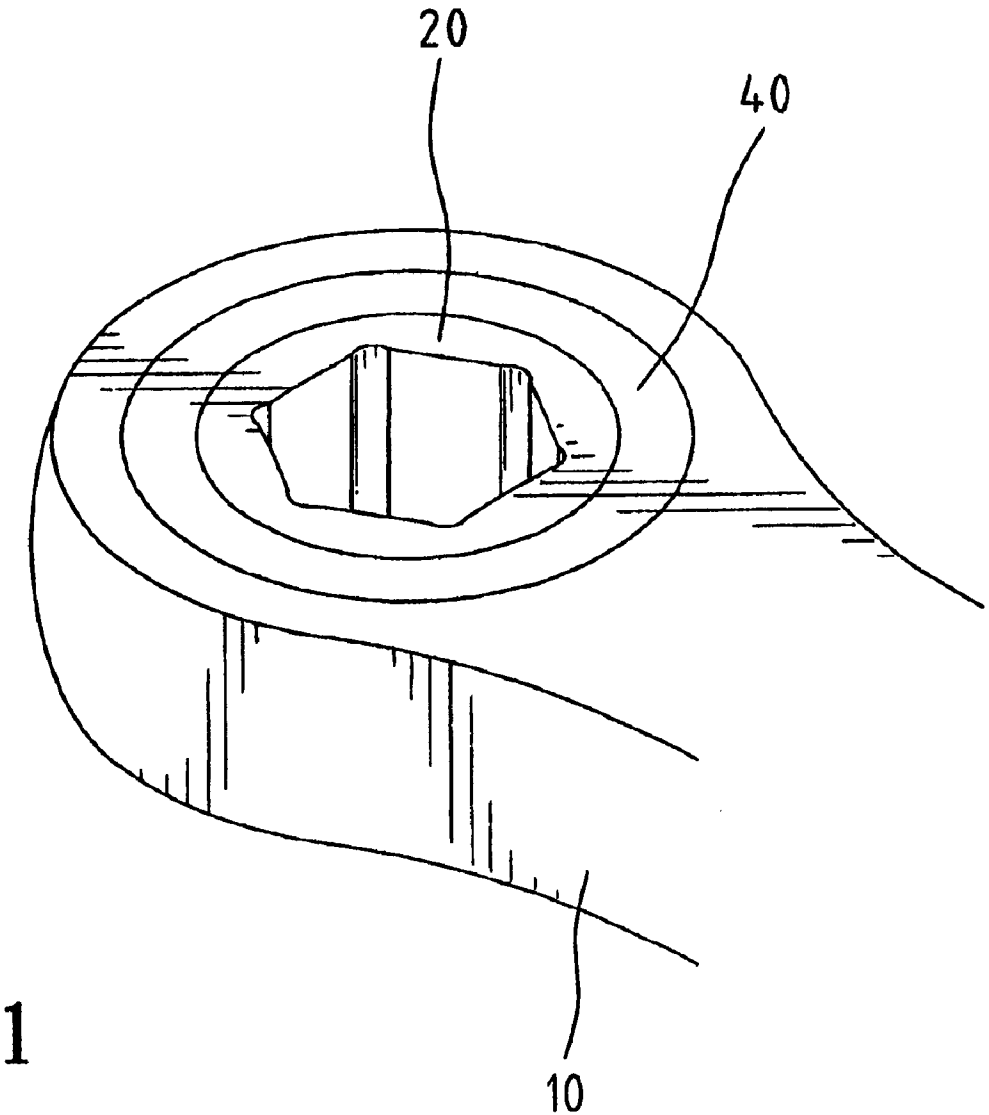
FIG. 1 is a perspective view of a portion of a wrench in accordance with the present invention.
Figure 2:
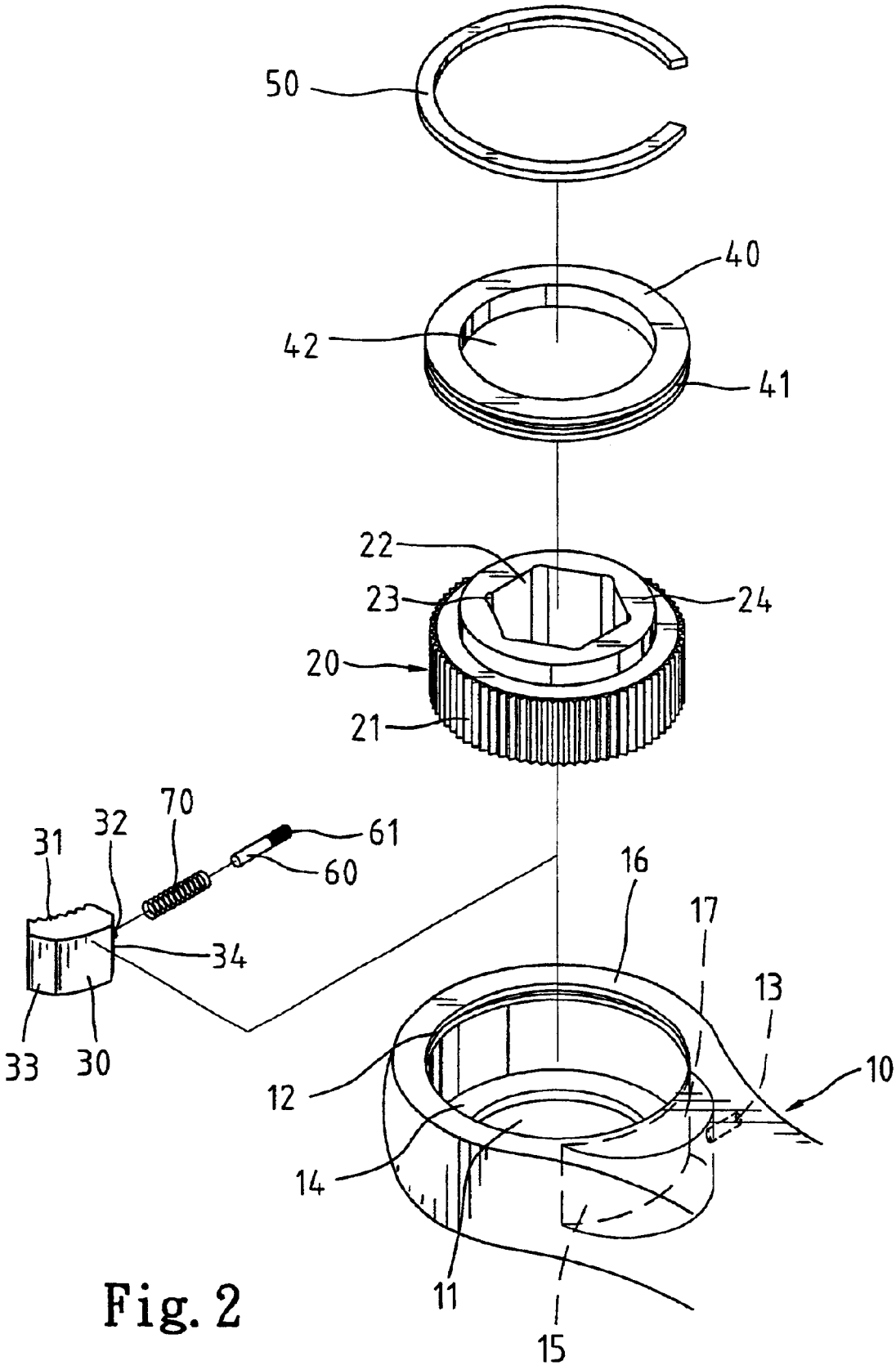
FIG. 2 is an exploded perspective view of the portion of the wrench in FIG. 1.
Figure 3:
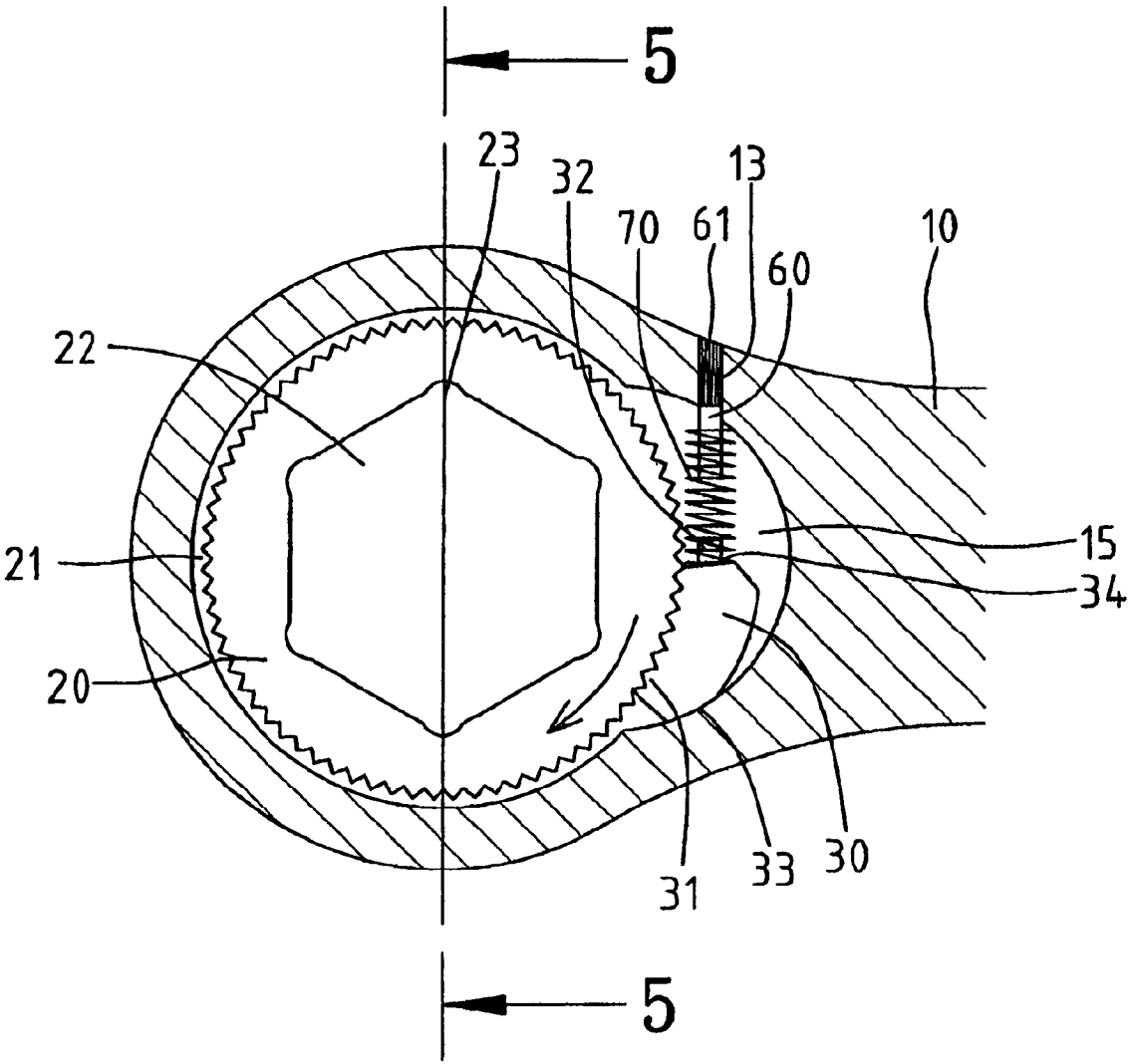
FIG. 3 is a sectional view of the portion of the wrench in FIG. 1.

Referring to FIGS. 1 through 7 and initially to FIGS. 1 through 3, a wrench in accordance with the present invention generally includes a handle 10 and a head 16 extended from the handle 10. The head 16 includes a compartment 11. An upper portion of an inner periphery defining the compartment 11 includes an annular groove 12. An annular ledge 14 projects inward from a lower portion of the inner periphery defining the compartment 11. Defined in a web 17 between the handle 10 and the head 16 is a cavity 15 communicated with the compartment 11. In addition, a transverse hole 13 is defined in the web 17 and includes an inner end communicated with the cavity 15 and an outer end communicated with outside.

A drive member 20 is rotatably mounted in the compartment 11 and includes a plurality of teeth 21 on an outer periphery thereof. The drive member 20 further includes a polygonal inner periphery 22 for engaging with a fastener, such as a nut or a bolt head. A concave portion 23 is defined between two adjacent faces of the polygonal inner periphery 22. The concave portion 23 allows easy insertion of the fastener without the risk of deformation of the fastener.

A pawl 30 is mounted in the cavity 15 and includes a toothed side 31 (preferably arcuate) for engaging with the teeth 21 of the drive member 20. The pawl 30 further includes a peg 32 on an attachment side 34 thereof and a pressing side 33 that substantially faces away from the attachment side on which the peg 32 is formed.

An inner periphery 42 of a ring cap 40 is mounted around a protruded portion 24 protecting upward from a top of the drive member 20. The ring cap 40 includes an annular groove 41 in an outer periphery thereof A C-clip 50 is mounted between the annular groove 12 of the head 16 and the annular groove 41 of the ring cap 40, thereby rotatably mounting the drive member 20 the compartment 11, best shown in FIG. 5.

As illustrated in FIG. 3, an anchor 60 is securely mounted in the transverse hole 13. An elastic element 70 includes a first end attached to the peg 32 on the attachment side 34 of the pawl 30 and a second end attached to the anchor 60. An end 61 of the anchor 60 may be embossed to provide increased frictional contact with an inner periphery of the transverse hole 13, thereby retaining the anchor 60 in the transverse hole 13.

In assembly, the first end of the elastic element 70 is attached to the peg 32 on the attachment side 34 of the pawl 30, which is then mounted into the cavity 15. The anchor 60 is inserted into the transverse hole 13 via the embossed end 61 thereof and the second end of the elastic element 70 is attached to the other end of the anchor 60. The C-clip 50 is placed into the annular groove 41 of the ring cap 40, which, in turn, is mounted around the protruded portion 24 of the drive member 20. The drive member 20 is then mounted into the compartment 11 via an upper end of the compartment 11. The annular ledge 14 prevents falling of the drive member 20. The C-clip 50 expands outward and thus engages with the annular groove 12 of the head 16. Thus, assembly of the wrench is completed easily due to the simple structure of the wrench.

Referring to FIG. 3, when the handle 10 is turned clockwise, the pressing side 33 of the pawl 30 presses against a wall defining the cavity 15. The teeth 21 of the drive member 20 reliably mesh with the toothed side 31 of the pawl 30. Thus, the fastener (not shown) engaged in the inner periphery 22 of the drive member 20 is driven clockwise.

Figure 4:
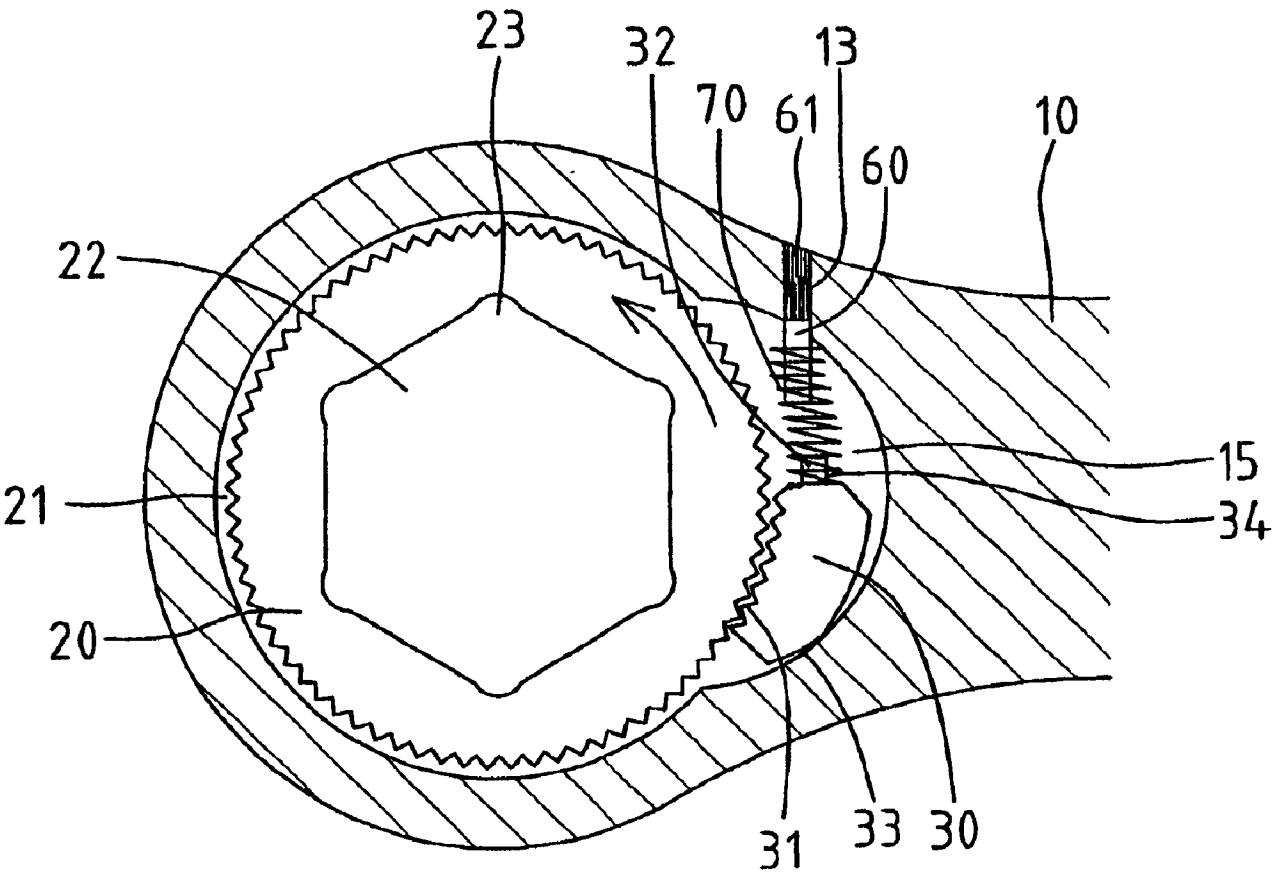
FIG. 4 is a sectional view similar to FIG. 3, wherein the wrench rotates freely.
Figure 5:
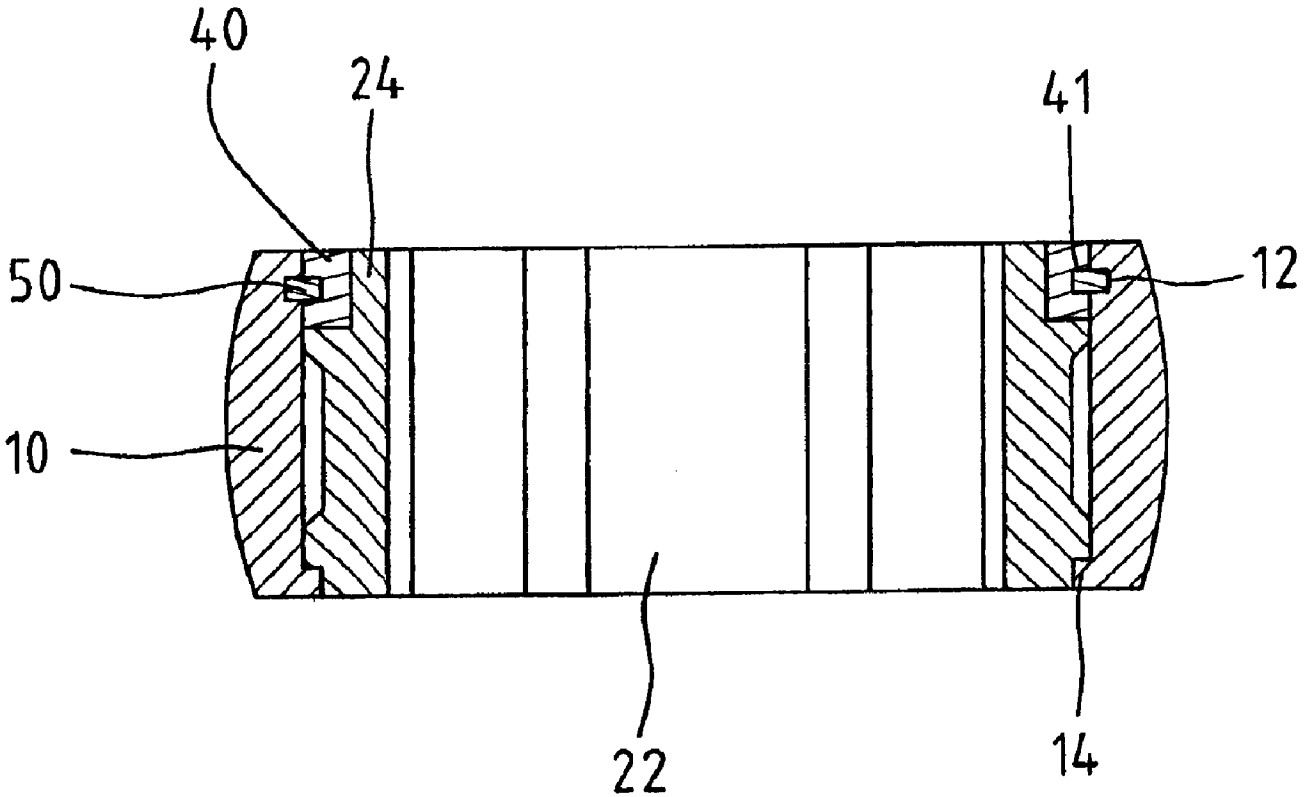
FIG. 5 is a sectional view taken along line 5—5 in FIG. 3.

Referring to FIG. 4, when the handle 10 is turned counterclockwise, the force imparted to the pawl 30 causes the pawl 30 to move away from the drive member 20 and to overcome the elastic element 70. The pressing side 33 of the pawl 30 cannot bear against the wall defining the cavity 15. Thus, free rotation occurs when the handle 10 is turned counterclockwise.

Figure 6:
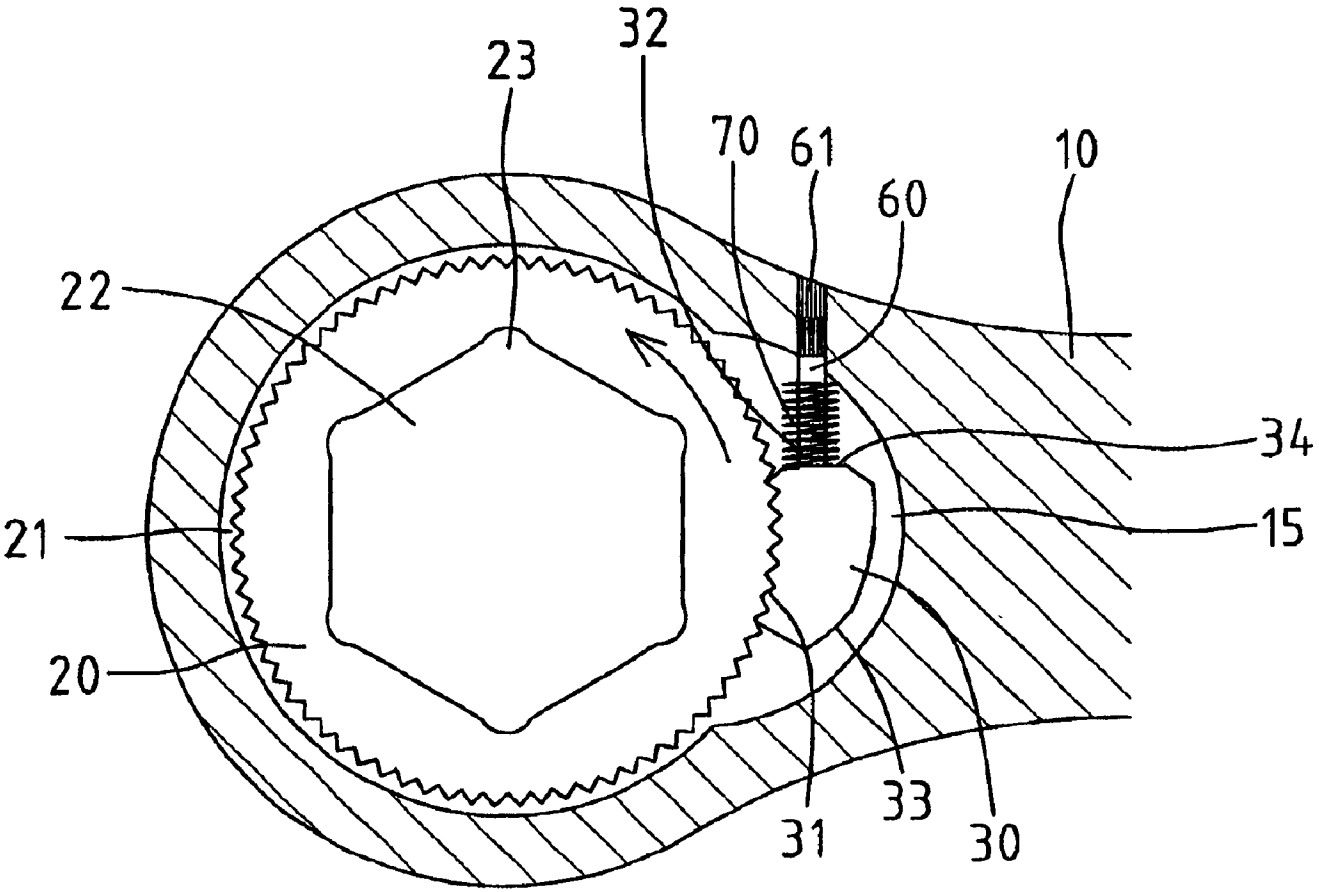
FIG. 6 is a sectional view similar to FIG. 3, wherein the pawl is stuck to the drive member.
Figure 7:
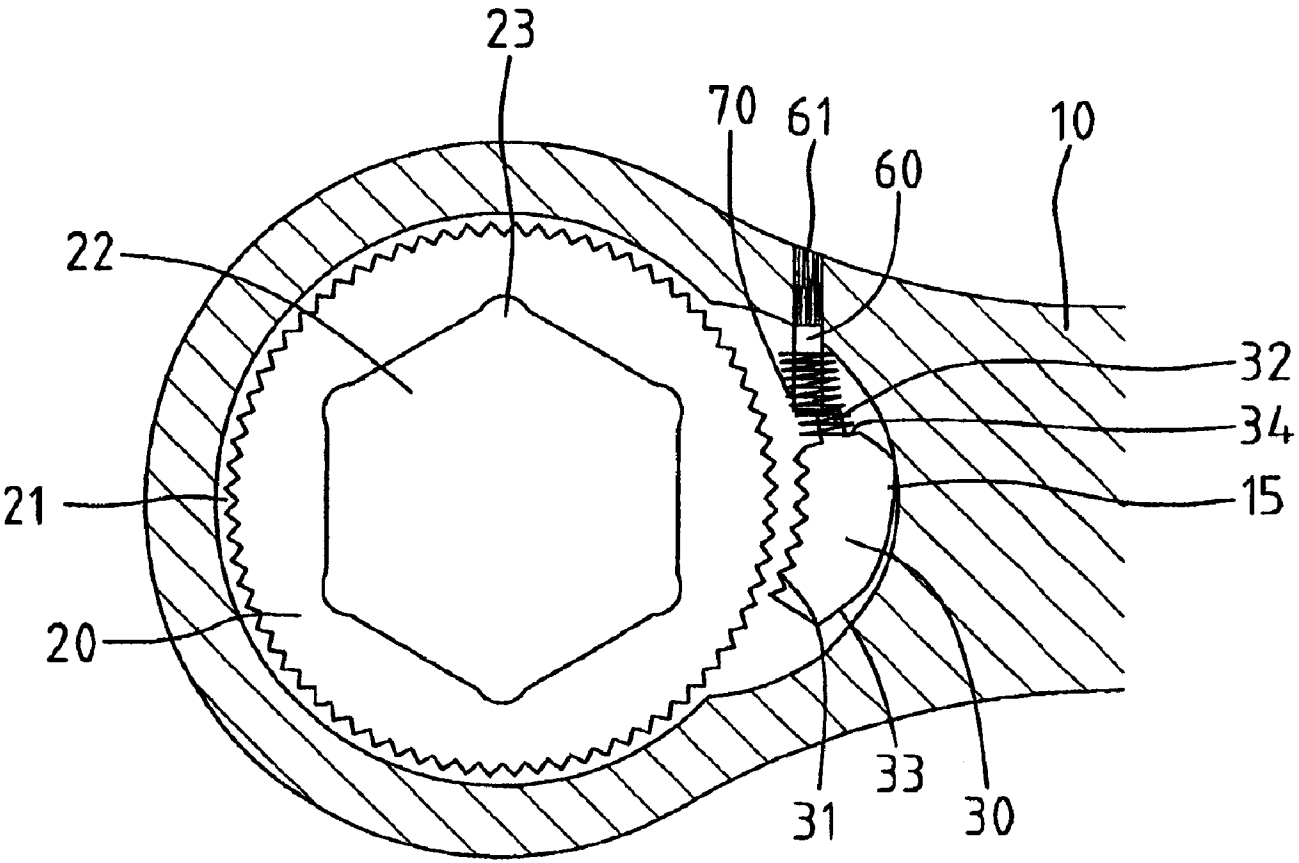
FIG. 7 is a sectional view similar to FIG. 6, wherein the pawl is disengaged from the drive member.

Referring to FIG. 6, in a case that the toothed side 31 of the pawl 30 is stuck to the teeth 21 of the drive member 20 due to rusting or other reasons, the pawl 30 will still be stuck to the drive member 20 when the handle 10 is turned counterclockwise. Referring to FIG. 7, when the handle 10 is further turned counterclockwise, the peg 32 on the attachment side of the pawl 30 will impinge the anchor 60. The impinging force will be large enough to disengage the pawl 30 from the drive member 20, best shown in FIG. 7. Namely, the stuck problem of the pawl 30 is solved.

It is noted that the compartment 11 of the wrench in accordance with the present invention can be processed by milling, which can be quickly achieved by computer numerical control (CNC). The overall structure of the wrench in accordance with the present invention is simple and the assembly procedure therefor is easy. The embossed end 61 of the anchor 60 allows it to be inserted into and thus retained in the transverse hole 13 without the need of threading engagement. The other end of the anchor 60 is located in the cavity 15 of the wrench and extended into a portion of the elastic element 70, which prevents malfunction of the elastic element 70 as a result of deformation. The pawl 30 and the drive member 20 are meshed with each other by a plurality of teeth to withstand a larger torque. In a case that the pawl 30 is stuck to the drive member 20 as a result of rusting or other reasons, the pawl 30 can be disengaged from the drive member 20 by means of simply turning the handle along the free rotating direction (i.e., counterclockwise in the embodiment described), which causes impingement to the pawl 30 by the anchor 60.

Figure 8:
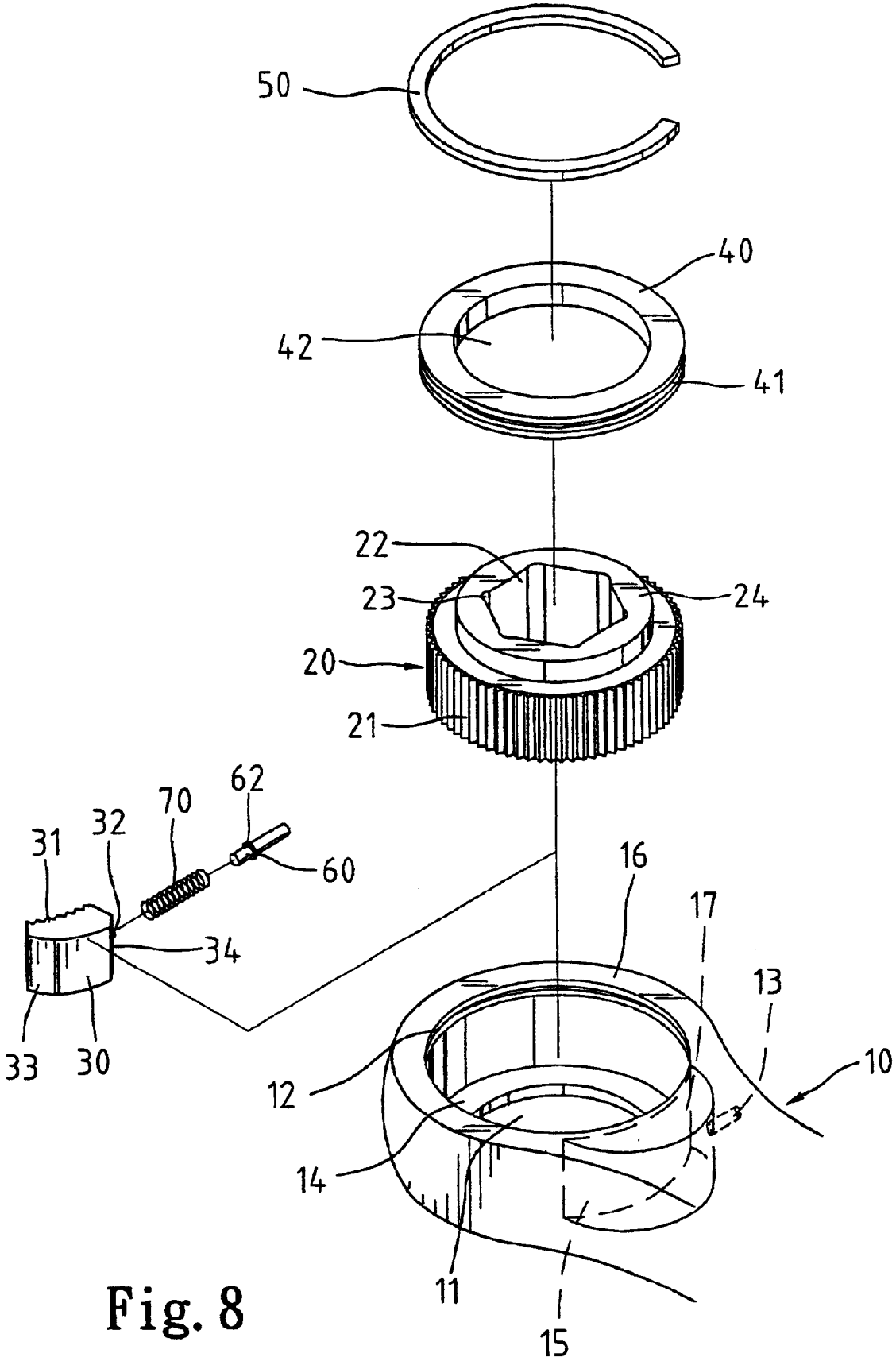
FIG. 8 is an exploded perspective view of a second embodiment of the wrench in accordance with the present invention.
Figure 9:
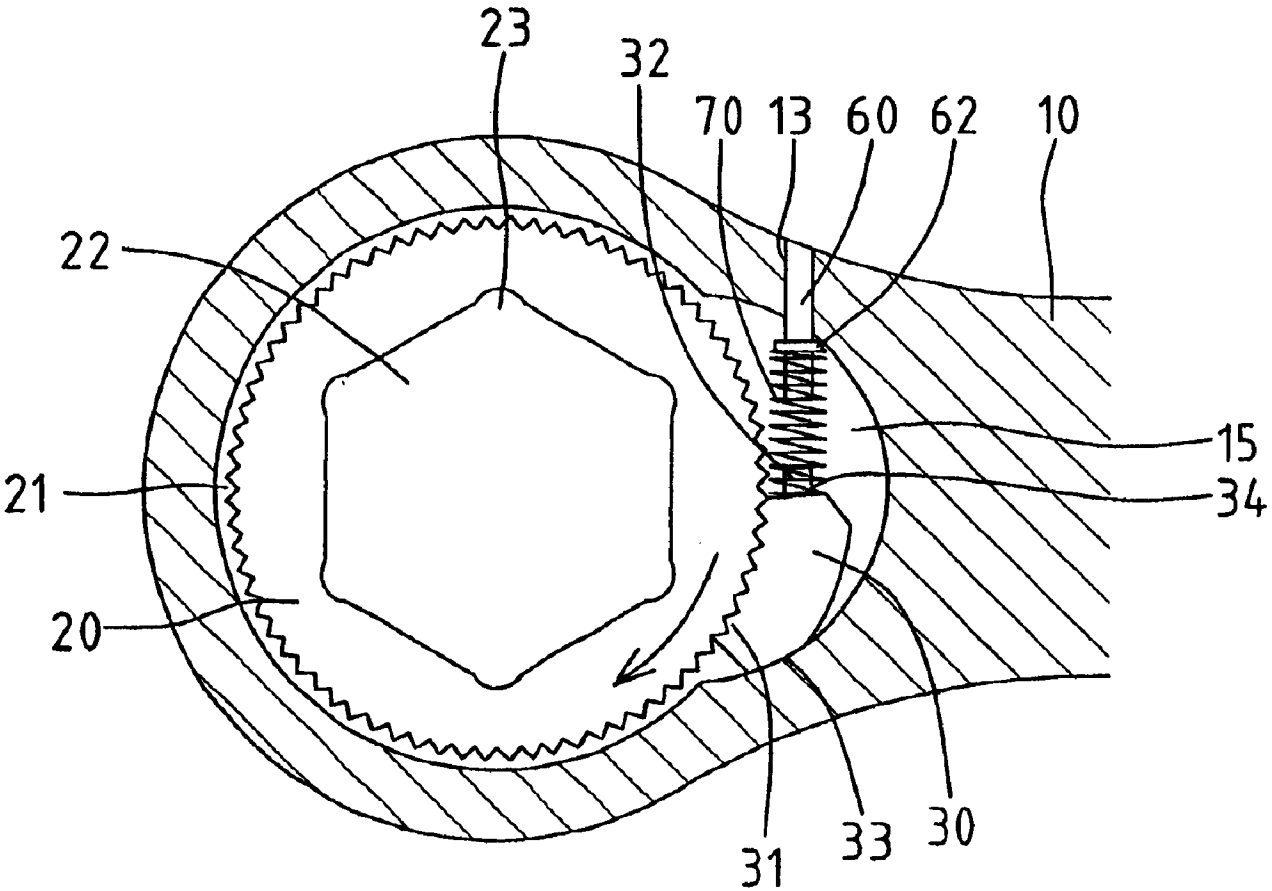
FIG. 9 is a sectional view of the wrench in FIG. 8.
Figure 10:
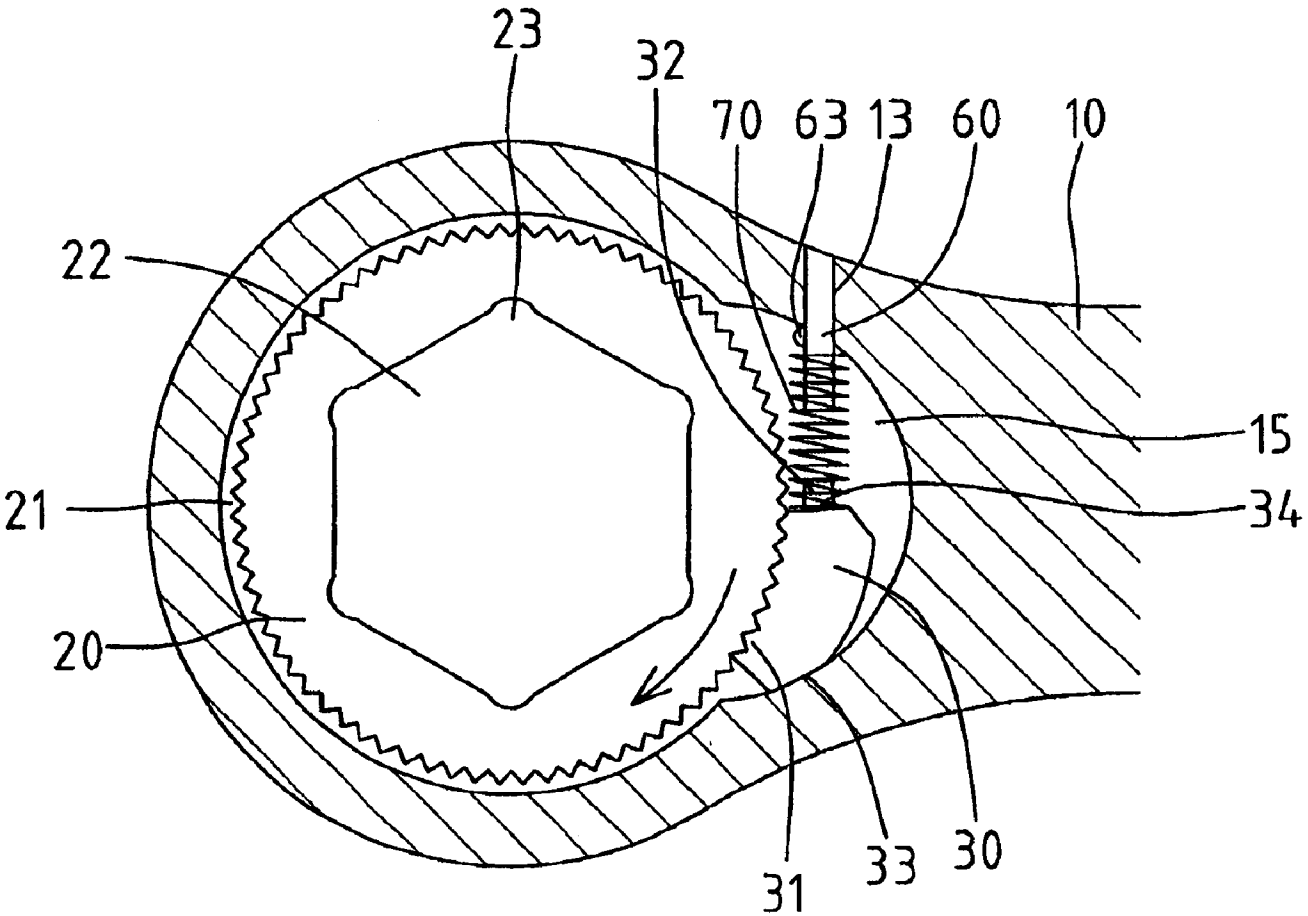
FIG. 10 is a sectional view of a third embodiment of the wrench in accordance with the present invention.
Figure 11:
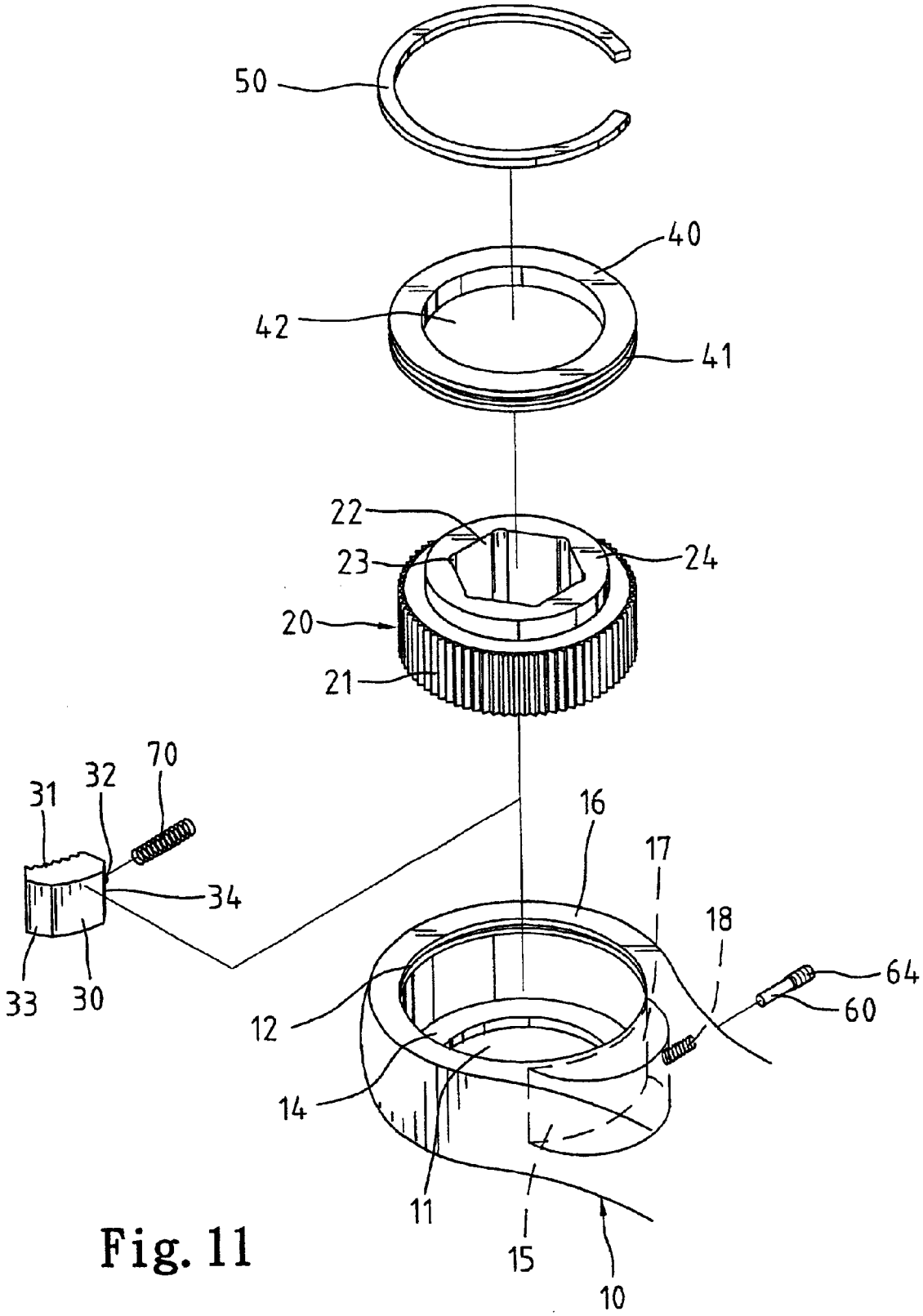
FIG. 11 is an exploded perspective view of a fourth embodiment of the wrench in accordance with the present invention.
Figure 12:
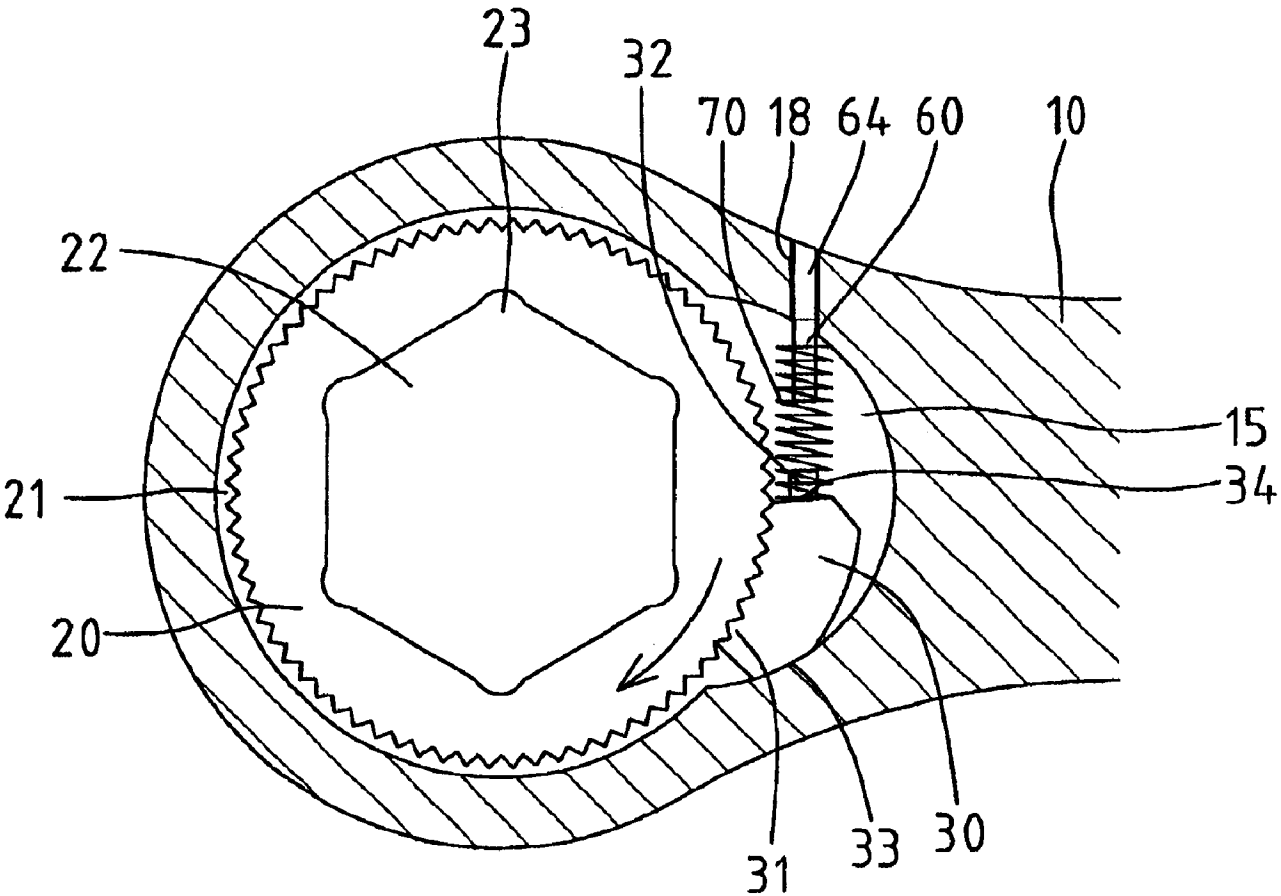
FIG. 12 is a sectional view of the wrench in FIG. 11.

FIGS. 8 and 9 illustrate a second embodiment of the wrench in accordance with the present invention, wherein the anchor 60 includes a flange 62 on an outer periphery thereof and located in the cavity 15, and the second end of the elastic element 70 is attached to the flange 62 of the anchor 60. FIG. 10 illustrates a third embodiment of the wrench in accordance with the present invention, wherein the anchor 60 includes a protrusion 63 on an outer periphery thereof and located in the cavity 15, and the second end of the elastic element 70 is attached to the protrusion 63 of the anchor 60. FIGS. 11 and 12 illustrate a fourth embodiment of the wrench in accordance with the present invention, wherein the transverse hole (now designated by "18") is a screw hole and the anchor 60 includes a threaded section 64 that is threadedly engaged in the screw hole 18. The second end of the elastic element 70 is also attached to the anchor 60.

The ratchet type ring spanner disclosed in U.S. Pat. No. 5,636,557 has no transverse hole that has an inner end communicated with the cavity defined in the web and an outer end communicated with outside. By contrast, the wrench in accordance with the present invention has a transverse hole 13, 18 having an inner end communicated with the cavity 15 defined in the web 17 and an outer end communicated with outside. Provision of the transverse hole 13, 18 allows easy assembly of the wrench, and the overall structure is simplified. Formation of the transverse hole 13, 18 of the present invention can be easily accomplished.

Although the invention has been explained in relation to its preferred embodiments, it is to be understood that many other possible modifications and variations can be made without departing from the scope of the invention as hereinafter claimed.

What is claimed is:

1. A wrench comprising:

a handle;

a head extended from the handle and including a compartment, a web being defined between the handle and the head, a cavity being defined in the web and communicated with the compartment, a transverse hole being defined in the web and including an inner end communicated with the cavity;

a drive member rotatably mounted in the compartment and including a plurality of teeth on an outer periphery thereof;

a pawl slidably mounted in the cavity and including a toothed side, an attachment side, and a pressing side;

an anchor securely mounted in the transverse hole; and an elastic element including a first end attached to the attachment side of the pawl and a second end attached to the anchor, the pawl being biased by the elastic element such that the toothed side of the pawl is biased to engage with the teeth of the drive member and that the pressing side of the pawl is biased to press against a wall defining the cavity, wherein the anchor includes an embossed end for frictional engagement with an inner periphery defining the transverse hole.

2. The wrench as claimed in claim 1, wherein the attachment side of the pawl includes a peg to which the first end of the elastic element is attached.

3. The wrench as claimed in claim 2, wherein the peg is impinged by another end of the anchor when the handle is turned in a free rotating direction and thus causes disengagement of the pawl from the drive member in a case that the pawl is stuck to the drive member.

4. The wrench as claimed in claim 1, wherein the drive member includes a protruded portion on a top thereof, with the wrench further comprising:

a ring cap mounted around the protruded portion, the ring cap including an annular groove in an outer periphery thereof, an inner periphery defining the compartment of the head including an upper portion with an annular groove; and a C-clip engaged in the annular groove of the ring cap and the annular groove of the head.

5. The wrench as claimed in claim 4, wherein the inner periphery defining the compartment of the head includes an annular ledge projecting inward from a lower portion thereof.

6. The wrench as claimed in claim 1, wherein the drive member includes an inner periphery for engaging with a fastener.

7. The wrench as claimed in claim 6, wherein the inner periphery of the drive member includes a plurality of faces, each two adjacent said faces having a concave portion therebetween.

8. A wrench comprising:

a handle;

a head extended from the handle and including a compartment, a web being defined between the handle and the head, a cavity being defined in the web and communicated with the compartment, a transverse hole being defined in the web and including an inner end communicated with the cavity and an outer end communicated with outside of the head, with the transverse hole extending through the web from an inner periphery defining the cavity to the outside of the head;

a drive member rotatably mounted in the compartment and including a plurality of teeth on an outer periphery thereof;

a pawl slidably mounted in the cavity and including a toothed side, an attachment side, and a pressing side;

an anchor securely mounted in the transverse hole; and an elastic element including a first end attached to the attachment side of the pawl and a second end attached to the anchor, the pawl being biased by the elastic element such that the toothed side of the pawl is biased to engage with the teeth of the drive member and that the pressing side of the pawl is biased to press against a wall defining the cavity, wherein the drive member includes an inner periphery for engaging with a fastener, wherein the anchor includes an embossed end for frictional engagement with an inner periphery defining the transverse hole.

9. The wrench as claimed in claim 6, wherein the attachment side of the pawl includes a peg to which the first end of the elastic element is attached.

10. A wrench comprising:

a handle;

a head extended from the handle and including a compartment, a web being defined between the handle and the head, a cavity being defined in the web and communicated with the compartment;

a drive member rotatably mounted in the compartment and including a plurality of teeth on an outer periphery thereof;

a pawl slidably mounted in the cavity and including a toothed side, an attachment side, and a pressing side;

an anchor mounted in the cavity; and an elastic element including a first end attached to the attachment side of the pawl and a second end attached to the anchor, the pawl being biased by the elastic element such that the toothed side of the pawl is biased to engage with the teeth of the drive member and that the pressing side of the pawl is biased to press against a wall defining the cavity, wherein the attachment side of the pawl includes a peg to which the first end of the elastic element is attached, wherein the peg is impinged by an end of the anchor and thus causes disengagement of the pawl from the drive member in a case that the pawl is stuck to the drive member.

11. The wrench as claimed in claim 10, wherein the anchor includes a flange on an outer periphery thereof and located in the cavity, and wherein the second end of the elastic element is attached to the flange of the anchor.

12. The wrench as claimed in claim 10, wherein the anchor includes a protrusion on an outer periphery thereof and located in the cavity, and wherein the second end of the elastic element is attached to the protrusion of the anchor.

13. The wrench as claimed in claim 10, wherein the transverse hole is a screw hole, and wherein the anchor includes a threaded section that is threadedly engaged in the screw hole.

14. The wrench as claimed in claim 1, wherein the transverse hole includes an outer end communicated with outside of the head, with the transverse hole extending through the web from an inner periphery defining the cavity to outside of the head.

15. The wrench as claimed in claim 10, with a transverse hole being defined in the web and including an inner end communicated with the cavity, with the anchor having a first end securely mounted in the transverse hole, with the first end different than the end impinged by the peg.

16. The wrench as claimed in claim 15, wherein the transverse hole includes an outer end communicated with outside of the head, with the transverse hole extending through the web from an inner periphery defining the cavity to outside of the head.

17. The wrench as claimed in claim 15, wherein the anchor includes a flange on an outer periphery thereof and located in the cavity, and wherein the second end of the elastic element is attached to the flange of the anchor.

18. The wrench as claimed in claim 15, wherein the anchor includes a protrusion on an outer periphery thereof and located in the cavity, and wherein the second end of the elastic element is attached to the protrusion of the anchor.

19. The wrench as claimed in claim 15, wherein the transverse hole is a screw hole, and wherein the anchor includes a threaded section that is threadedly engaged in the screw hole.

* * * * *